United States Patent [19]

Aumercier

[11] Patent Number: 4,936,613

[45] Date of Patent: Jun. 26, 1990

[54] ELECTRICAL BLOCKING DEVICE FOR A FITTING SUCH AS AN ESPAGNOLETTE OR ESPAGNOLETTE LOCK

[75] Inventor: Laurent Aumercier, Phalsbourg, France

[73] Assignee: Ferco International, Sarrebourg, France

[21] Appl. No.: 249,949

[22] Filed: Sep. 27, 1988

[30] Foreign Application Priority Data

Oct. 2, 1987 [FR] France ..... 87 13822

[51] Int. Cl.[5] ..... E05C 9/04

[52] U.S. Cl. ..... 292/336.3; 292/144; 292/337

[58] Field of Search ..... 292/336.3, 144, 33, 292/39, 337, 201, 150; 70/443, 448

[56] References Cited

U.S. PATENT DOCUMENTS

| | | | |
|---|---|---|---|
| 2,947,160 | 8/1960 | Walters | 292/33 X |
| 3,086,383 | 4/1963 | Scott | 292/39 X |
| 4,099,752 | 7/1978 | Geringer | 292/144 |
| 4,784,415 | 11/1988 | Maloval | 292/144 |

*Primary Examiner*—Richard E. Moore

*Attorney, Agent, or Firm*—Sandler, Greenblum & Bernstein

[57] ABSTRACT

A fitting for doors, windows or the like including an espagnolette or espagnolette lock fitted in a case in which is housed a control mechanism permitting the activation of at least one operating rod and an electrical blocking device. In order to avoid significant modifications to the standard espagnolette or espagnolette lock, the electrical blocking device is in the form of a separate assembly placed either at any place at the front edge of the leaf of the door or window, or aligned with the prolongation of and coupled with the case of the espagnolette or espagnolette lock.

20 Claims, 1 Drawing Sheet

ELECTRICAL BLOCKING DEVICE FOR A FITTING SUCH AS AN ESPAGNOLETTE OR ESPAGNOLETTE LOCK

The invention relates to a fitting for doors, windows or similar comprising, on the one hand, an espagnolette or espagnolette lock fitted with a case in which is housed a control mechanism permitting the activation of at least one operating rod and on the other hand, an electrical blocking device.

Scope of the Invention

The particular application of this invention will be in the field of hardware for buildings.

Usually, espagnolettes or espagnolette locks for doors, windows or similar are composed of a case in one piece with an edgeplate and in which is housed a control mechanism allowing the user to activate one or more locking elements.

As a general rule, the latter consist of one or two operating rods extending on either side of the case and sliding behind the edge-plate of the espagnolette or espagnolette lock. These rods are fitted with one or more locking devices such as catches or rollers, projecting from this edge-plate through openings machined in the latter, so as to engage with keepers in one piece with the casing of the door, window or similar.

In the case of espagnolette locks, these are provided with an element with a key which can block the translation of the operating rod(s) or block the action of the user on a control element such as a crutch handle, a button, etc. Furthermore, the control mechanism of these espagnolette locks permits the activation of another locking element, in particular a half-turn bolt.

In certain cases, it may prove of particular interest to provide for the remote control of the locking of a leaf fitted with such an espagnolette or espagnolette lock.

To do this, espagnolettes or espagnolette locks have been designed fitted with an electrical blocking device comprising drives which activate, directly or via a secondary connecting part, one or more locking elements. So these drives, consisting either of an electric motor or an electro-magnet, can control the displacement of a half-turn bolt and/or of a rod or rods.

As a general rule, these electrical blocking devices take up a good deal of room because of the drives which have to be sufficiently powerful to bring about the displacement of the locking elements. This means that the case of the espagnolette or espagnolette lock housing these drives will have to be larger than a standard case and will involve a deeper and broader notch being cut in the edge of the leaf so that the case can be recessed. Now, a specific recess of this kind means that tools different from those in general use will have to be applied. It should also be noted that the stile of the leaf must be thick enough to permit such a recess.

Moreover, for espagnolette locks, we know of means of driving intervening on the blocking system, for example the element with a key, to immobilize the locking elements. These drives need less power to impart translation or rotation to a blocking element during the blocking or locking of the leaf or a door, window or similar.

However, this reduction in the power of the drives does not permit the solution of the above-mentioned problems. Whatever the space taken up by a motor or an electro-magnet, if they have to be housed in the case of an espagnolette lock, this inevitably means that the case has to be larger. So a cut that is broader and, in any case, deeper has to be made in the edge of the leaf.

In certain cases, the electrical blocking device, and in particular the drives, are applied on the leaf and intervene on the control mechanism recessed into the edge of the leaf. This solution only partially solves the problem, since it is necessary to machine the inside face of this leaf.

Another disadvantage generally presented by the association of an electrical blocking device with an espagnolette or espagnolette lock is that many of the parts of the control mechanism of the latter must necessarily have a particular configuration to allow these drives to be incorporated.

This makes it necessary to manage a more cumbersome process of manufacture and to carry a larger stock so as to have espagnolettes or espagnolette locks some of which are fitted with an electrical blocking device and others not.

The purpose of this invention is to overcome all the above-mentioned disadvantages.

To do this, the invention concerns a fitting for doors, windows or similar comprising, on the one hand, an espagnolette or espagnolette lock fitted with a case in one piece with an edge plate and in which is housed a control mechanism permitting the activation of at least one operating rod and, on the other hand, an electrical blocking device, characterized by the fact that this electrical blocking device is in the form of an assembly separate from the espagnolette or espagnolette lock and situated in the longitudinal prolongation of the case of the latter.

The advantages obtained thanks to this invention consist essentially in the fact that the placing of the electrical blocking device in relation to the case of the espagnolette or espagnolette avoids having to make a deeper and broader out in the stile of the leaf. All that is necessary is an additional longitudinal out, and this means that standard tools can be used It should be noted that this additional out can be made either in the immediate prolongation of the out made for the case of the espagnolette or espagnolette lock, or at any place on the edge of the leaf.

Another advantage obtained thanks to this invention consists in the fact that the association of an electrical blocking device with an espagnolette or espagnolette lock no longer involves modifications to the elements of the control mechanism and hardly any modifications to the case housing the latter. This means that it is advantageous to be able to adapt the electrical blocking device to any espagnolette or espagnolette lock already installed, with very few modifications having to be made except for the longitudinal enlargement of the cut.

Figure 1:
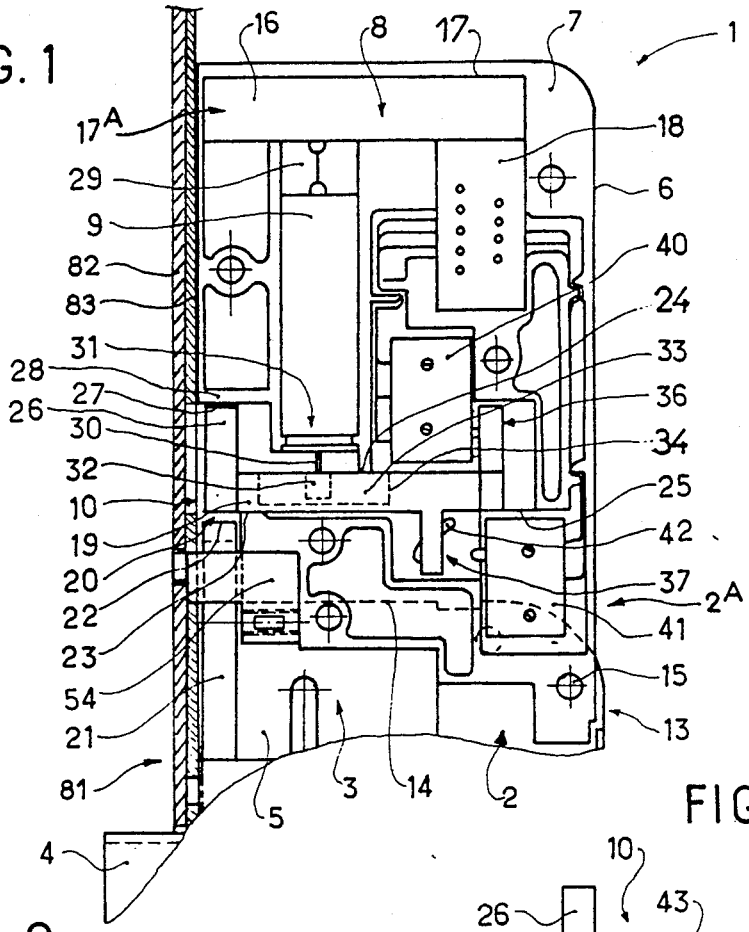
FIG. 1 is a partial schematized view, in elevation, of a fitting according to the invention, comprising an espagnolette or espagnolette lock and an electrical blocking device (the covers of the oases of this electrical blocking device and of the espagnolette or espagnolette lock have been removed).
Figure 2:
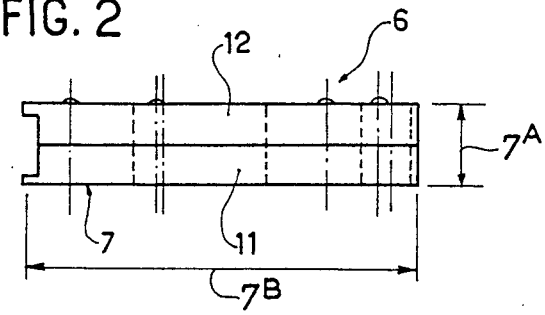
FIG. 2 is a plan view of the case of the electrical blocking device.

We refer in particular to FIGS. 1 and 2.

The fitting 1, for doors, windows or similar, according to the invention, comprises an espagnolette or espagnolette lock 81, consisting essentially of a case 2 applied to the inner face of an edge-plate 82 and intended to be recessed in the edge of a leaf.

The case 2 serves as housing for a control mechanism 3 the function of which is to transmit the action of a user to any particular element of control, such as a crutch handle or an element with a key, controlling one or more locking elements.

This control mechanism 3 permits the activation of at least one operating rod 83 extending on one side or the other of the case 2. This operating rod carries, as a general rule, a variety of locking elements such as rollers, catches or others which are able to cooperate with the keepers placed on the frame.

In the case of an espagnolette lock, the control mechanism 3 also permits the activation of another locking element, in particular a half-turn bolt 4.

When an espagnolette or espagnolette lock is fitted with two operating rods extending on either side of the case 2, these are moved by the action of the control mechanism 3, either following directions opposite from one another, or the same direction as one another. In the latter case, these operating rods are generally linked by a rack 5 or other element housed in the case 2 and acted on by the control mechanism 3.

According to the invention, the fitting 1 comprises an electrical blocking device 6 remotely controlled, the function to which is to immobilize in the locked position, after the leaf of the door, window or similar has been closed, a moving element of the control mechanism 3 and/or of the operating rods of the espagnolette or espagnolette lock.

Advantageously, this electrical blocking device 6 is situated in the longitudinal prolongation of the case 2 and is in the form of a second case 7.

The latter case houses the elements of electrical control 8 activating the drives 9 which cause the means of blocking 10 to move.

So this case 7 is composed of a cover 11 and a base 12 which are enantiomorphous and comprise a series of housings in which the above-mentioned elements are placed. It Is important to note that the thickness 7A and the breadth 7B of this case 7 do not exceed the corresponding dimensions of the case 2 of the espagnolette or espagnolette lock. This allows identical tools to be used when making the cut in the edge of the leaf.

Moreover, according to the invention, this electrical blocking device can be recessed in the edge of a leaf, either in the immediate prolongation of the case 2 and coupled to it, or at any place on one side or another of the latter.

In the first case involved, the cover 11 and the base 12 of the case 7 have, as shown in FIG. 1, a particular shape for the part of them marked 13 which cooperates with the case 2, the function of this characteristic being to ensure that they are adapted to one of the extremities 2A of the latter.

More exactly, this case 2, at one of its extremities 2A situated on the longitudinal axis of the operating rod(s), lacks the wall forming the edge and connecting the front and rear cover plates of this case 2. In this way, the part 13 of the cover 11 and the base 12 constituting the case 7 can be partially introduced, for example, in the upper edge 14 of the case 2, as shown in FIG. 1, and play the role of a spacer inserted between the covering walls of the latter. This part 13 of the cover 11 and the base 12 is also provided with orifices 15 corresponding with the openings machined in these cover plates. These orifices serve for the passage of fixing elements such as screws, rivets or others, to make the electrical blocking device 6 in one piece with the case 2 of the espagnolette or espagnolette lock.

The enantiomorphous character of the cover 11 and the base ensures that the electrical blocking device can be reversed, not only for right-left use on the leaf, but also in relation to a median plane transversal to the case 2 of the espagnolette or espagnolette lock.

The electrical control elements 8 permitting the activation of the drives 9 are composed of a system of control relays 19 placed in a housing 17 in the upper part 17A of the case 7. These electrical control elements 8 also comprise a connection element 18 permitting connection to an outside su linked, for example, to a control centre.

To gain access to the connection element 18, the base 12 and/or the cover. 11 has a slot for the introduction of a connection cord.

The electrical control elements 8 intervene on the working of the drives 9, more particularly on an electric motor driving the means of blocking 10.

It is, however, possible to consider the substitution of an electro-magnet for this electric motor to drive the means of blocking 10. In these conditions, the modifications which should be made to the case 7 and, in general, to all the elements constituting the electrical blocking device 6, can be made by any serious specialist. This makes it quite clear that this substitution can be carried out without departing from the spirit of this invention.

The means of blocking 10 activated by the electric motor 9 consist, substantially, of a slide 19 moving in the case 7 perpendicularly to the longitudinal axis of the operating rod. Thus the front extremity 20 of this slide 19 is able to cooperate, in the blocking position, either with one of these operating rods or with a connecting element 21 connected to the control mechanism 3. According to another mode of working, this front extremity 20 of the slide 29 can immobilize either an operating rod, or a connecting element 21 and, simultaneously, cooperate with the edge-plate of the espagnolette or espagnolette lock. In these conditions, this edgeplate plays the role of keeper and comprises, for this purpose, an opening or slot into which the means of blocking 10 are partially inserted.

The connection element 21 necessarily presents a displacement following a direction more or less parallel to these operating rods, from the action of the control mechanism 3.

FIG. 1 represents a fitting in which the electrical blocking device 6 and, in particular, the slide 19, cooperates with such a connection element 21. In this precise case, the latter is connected to the rest 5, conferring an identical displacement to two operating rods situated on either side of the case 2. However, in other cases considered, this connection element 21 can be connected to any part of the control mechanism 3 and of which the displacement is made according to the above-mentioned conditions.

Thus, according to the configuration described above, the blocking of the leaf of a door, window or similar is obtained by displacing the slide 19 in the direction of the edge-plate, in such a way that its front extremity 20 is positioned above the upper edge 22 of the connection element 21, immobilizing the latter in the locked position. Conversely, the withdrawal of the slide l frees the control mechanism 3 by assuring to this connection element 21 a displacement parallel to the operating rods.

The slide 19 is guided by an assembly of bearing surfaces 23, 24, 25 made in the base 12 and in the cover 11 of the case 7. It can, however, occur that the strain exercised by a malefactor or a clumsy user on the control element of the fitting makes the slide 19 bend from the effect of the thrust exercised by the connection element 21. To get over this disadvantage, the slide 19 is provided at its front extremity 20 with a block 26 whose upper edge 27 cooperates with a bearing surface 28 made in the bottom 12 and the cover 11, in parallel to the displacement of the slide 19. In the blocking position, this block 26 comes to rest in the prolongation of the connection element 21.

Figure 4:
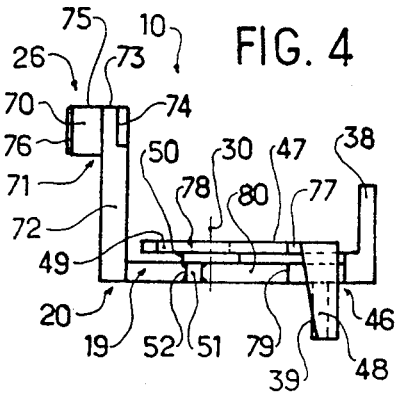
FIG. 4 is a view in elevation of the means of blocking of the electrical blocking device, according to a third mode of execution.

According to another mode of construction, as represented in FIG. 4, this block 26 is in the form of an element entirely inserted in the upper extremity 71 of a vertical branch 72 in one piece with the upper edge 20 of the slide 19. To do this, a cut is made in the upper edge 73 of this vertical branch 72, the lateral edges of the out being such that they can be inserted into grooves 74 machined either side of the block 26. Thus, as described above, the latter is able to located, in the locked position, above the connection element 21, or again to act on an operating rod. This block 26 or, more precisely, the element 27, also cooperates with its upper edge 75 with the bearing surface 28 made in the base 12 and the cover 11, and can do so whatever the position of the slide 19.

In the context of direct cooperation between the means of blocking 10 and an operating rod of the espagnolette or espagnolette lock, this operating rod is provided with a slot which, in the locked posit ion, is situated at the right of the slide 19 In this configuration, the front extremity 20 of the latter, whether or not it lacks a block 26, is inserted in this slot made in the operating rod to immobilize the latter.

Furthermore, the block 26, whether or not defined by a dissociable element, can advantageously constitute a blocking bolt such as to penetrate, in the locked position, into the keeper formed by the opening in the edge-plate. This configuration confers complete reliability on the electrical blocking device 6, since a forced action on the control mechanism 3 can in no case damage the blocking device.

It should also be noted that the block 26, in the form of the element 70, can be designed in a material that is more resistant than that of the slide 19. This results in reducing the cost of manufacturing the latter and in a longer life for the electrical blocking device 6.

Preferentially, the front extremity 20 of the slide 19 or the front face 76 of the block 26 (whatever the configuration) are slightly chamfered on their contour or their lower part is cut on the bias to permit their insertion either in a slot machined in the operating rod and/or in the edge-plate, or above the upper edge 22 of the connecting element 21.

The electric motor 9, which permits the slide 19 to be moved, is introduced into a housing 29 made in the cover 11 and the base 12 of the case 7. More particularly, this housing 29 assures the blocking in rotation of the electric motor 9. For this purpose, its shape is essentially cylindrical and it has on its inside wall and at one of its extremitIes an inside edge cooperating with a peripheral groove made in the wall of the electric motor 9. When assembling, it is important that the insertion of this inside edge into the peripheral groove is made with a certain resistance. It is, of course, possible to consider other means of blocking the rotation of the electric motor 9.

The housing 29 also permits the latter to be positioned in relation to the slide 19. So, according to the invention, this housing 29 is located in such a manner that the drive shaft 30 of the electric motor 9 is presented perpendicularly to the displacement of the slide 19 and is able to cooperate with the latter via appropriate means of driving 31.

According to a first mode of execution, the means of driving 31 consist of the toothed wheel 32 mounted on the extremity of the drive shaft 30 and cooperating with a rack 33 machined in a slot 34 made in the slide 19.

This means that the drive of the electric motor 9 causes the toothed wheel 32 to rotate and causes the translation of the slide 19 inside the case 7.

Preferentially, the slide 19 comprises means of control 36, 37 for stopping the working of the electric motor 9. So these means of control 36, 37 consist of wings 38, 39 extending, respectively, either side of the slide 19. These wings 38, 39 constitute control pins activating, respectively, a blocking stop interruptor 40 and an opening stop interruptor 41. These interruptors are named according to their function. Thus the blocking stop interruptor 40 causes the electric motor 9 to stop when the slide 19 is in the advanced blocking position. Conversely, the opening stop interruptor 41 causes the electric motor 9 to stop when the slide 19 is in the retracted position and has freed the control mechanism 3 and, more particularly, the connection element 21 or the operating rod.

Advantageously, one, 39, of the wings 38, 39 extending on either side of the slide 19 also serves as an element for the manual control of the latter. For security reasons, it appears indispensable to be able to control the unblocking of the operating rods of the espagnolette or espagnolette lock when the electrical blocking device 6 is put out of use or if its control in inaccessible.

For this purpose, the base 12 and/or the cover 11 is provided with a slot 42 placed to the right of the wing 39 to assure the accessibility of the later and to control the advance and, as a general rule, the backward movement of the slide 19.

The machining of the rack 33 of the slide 19 may turn out to be a particularly delicate operation to perform. To get round this disadvantage, the means of drive 31 can be formed, in a second mode of execution, of an eccentric in one piece with a disc rotated by the drive shaft 30 of the electric motor 9.

Figure 3:
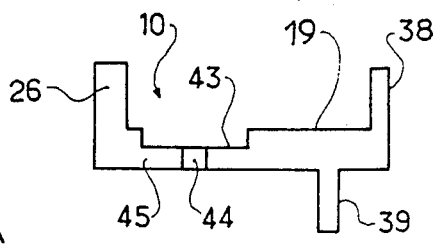
FIG. 3 is a view in elevation of the means of blocking of the electrical blocking device, according to a second mode of execution.

In these conditions, the slide 19 comprises, as shown in FIG. 3, on the one hand a groove 43 in which the disc mentioned above is housed and displaced. On the other hand, the slide 19 is provided with a cut 44 machined in one of its lateral edges 45 and extending transverally to its longitudinal axis. This means that when the electric motor 9 is working, the eccentric revolves inside the cut 44 while causing the slide 19 to advance or to move backwards.

However, driving the slide 19 via an eccentric may present a disadvantage, particularly in the case of a manual unblocking control. The fact is that a manual control of thIs kind, obtained by intervening on the wing 39, may prove to be practically impossible when the eccentric is situated more or less in the longitudinal axis of the slide 19, thus in the alignment of the drive shaft 30 of &he electric motor 9 and in the prolongation of the effort applied to this wing 39.

To get over the above-mentioned disadvantage, the means of driving 31, according to a third mode of execution shown in FIG. 4, consist, on the one hand, of a disc 50 in one piece with the drive shaft 30 and carrying an eccentric 51. The latter is inserted into a out 52 machined in the slide 19 and of a shape identical with that of the cut 44 described above. On the other hand, these means of driving 31 comprise a manual push button control 46 composed of a wing 47 extending parallel to and above the slide 19 and of a control lever 48 in one piece with one of the longitudinal edges 77 of this wing 47 and being prolonged below the slide 19.

More precisely, the wing 47 of this push button control 46 is provided with a rack 49 meshing with a toothed crown 78 surmounting the disc 50. In addition, the control lever 48 is inserted into a recess 79 made in the lateral edge 80 of the slide 19 and is presented in the same plane, perpendicular to the case 7, as the wing 39 constituting the means of stop control 37. This configuration assures the accessibility of this control lever 48 via the slot 42.

For the proper working of these means of driving 31, in conformity with the third mode of execution, it is important to ensure that there is a certain amount of play, either of the accentric 51 in the out 52, or of the control lever 48 in the recess 79.

The advantage of a manual push button control of this kind consists in the fact that it is possible to transmit a tangential force to the toothed crown 78, and to do so whatever the position of the eccentric 51 in the cut 52 in relation to the longitudinal axis of the slide 19.

Figure 5:
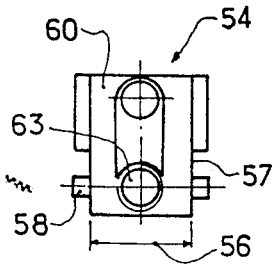
FIG. 5 is a view in elevation of the guide element related to one extremity of the case of the espagnolette or espagnolette lock.
Figure 6:
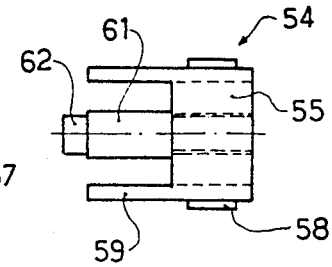
FIG. 6 is a plane view of the guide element shown in FIG. 5.

FIGS. 5 and 6 show a guide element 54 inserted in the extremity 2A of the case 2 of the espagnolette or espagnolette lock, where the electrical blocking device 6 is situated. More precisely, this guide element 54 ensures that the functions normally carried out by the edge of the case can be assured, although this edge does not exist in the espagnolette or espagnolette lock represented in FIG. 1.

So this guide element 54 assures the maintenance and guiding of the operating rod and, in addition, the connection between the case 2 and the edge-plate. Advantageously it also permits the connection element 21 to be guided during its displacements parallel to the longitudinal axis of the operating rod(s).

According to a preferential configuration, this guide element 54 is composed of a body 55 in parallelipedal shape with a breadth 56 more or less equal to the gap maintained between the front and rear cover plates forming the case 2. This body 55 is provided, on its lateral edge 57, with a tongue 58 cooperating with an opening made in these cover plates in order to assure, after assembly of these plates, the connection between the guide element and the case 2.

In addition, two flanks 59 situated on these same lateral edges 57 of the body 55, protrude from the front face 60 of the latter. Between these two flanks 59, an operating rod and the connecting element 21 are made to displace simultaneously.

This front face 60 of the body 55 also has a central boss 6 which comes to insert itself into the slots machined respectively in this connecting element 21 and in the operating rod. A stud 62, located on this central boss 61, allows the case 2 of the espagnolette or espagnolette lock to be positioned on the edge plate. In addition, a threaded orifice 63 situated under the central boss 61 allows a screw to be inserted to connect them.

It is obvious that such a guide element 54 is useful only in the case of a fitting in which the electrical blocking device 6 is coupled to the case 2 of the espagnolette or espagnolette lock and/or in which the means of blocking 10 cooperate with a connecting element 21 and not with an operating rod.

The advantages obtained thanks to this fitting in conformity with the invention consist in the fact that the out which has to be made in the stile of a leaf in order to recess the case or the espagnolette or espagnolette lock and the electrical blocking device has dimensions, in particular of depth and breadth, which are of the standard type habitually used for the traditional espagnolettes and espagnolette locks.

Moreover, the elements constituting the latter, and in particular, the control mechanism and their case, differ only in minor details from those used in the fitting according to this invention.

I claim:

1. A fitting for a door, window, or the like, said fitting comprising:

(a) a first case and a second case, each case having a longitudinal axis;

(b) an espagnolette housed in said first case;

(c) control means for controlling latching of said espagnolette;

(d) an operating rod which is actuatable by said control means to latch said espagnolette;

(e) an electric blocking device which is separate from said espagnolette and said control means and is housed in said second case, said electric blocking device holding said espagnolette in the latched position; and (f) the widths of said first case and said second case being substantially the same, said second case being coupled to said first case, so that the longitudinal axis of said second case is substantially aligned with a prolongation of the longitudinal axis of said first case.

2. The fitting according to claim 1, wherein said second case comprises a cover and a base which are connected together, and further comprising electrical control means housed in said second case for controlling movement of said electric blocking device, said second case having a slot for connection to a source of electricity, and actuating means for moving said electric blocking device to hold said espagnolette in the latched position.

3. The fitting according to claim 2, wherein said electric blocking device cooperates with said operating rod to hold said espagnolette in the latched position.

4. The fitting according to claim 2, further comprising a connecting element connected to said control means, said connecting element being movable substantially parallel to said operating rod, said electric blocking device cooperating with said connecting element to hold said espagnolette int he latched position.

5. The fitting according to claim 4, further comprising an edge plate, said electric blocking device also cooperating with said edge plate in the latched position.

6. The fitting according to claim 2, said first case including cover plates, wherein at least one of said cover and said base includes a portion inserted between said cover plates at an end of said first case.

7. The fitting according to claim 6, wherein said portion and said cover plates include respective openings for passage of fastening elements.

8. The fitting according to claim 3, wherein said blocking device includes a slide, said slide moving in a substantially perpendicular direction to said operating rod, with a front extremity of said slide cooperating with said operating rod.

9. The fitting according to claim 4, wherein said blocking device includes a slide, said slide moving in a substantially perpendicular direction to said operating rod, a front extremity of said slide cooperating with said connecting element.

10. The fitting according to claim 8, wherein said slide includes a block at said front extremity, said operating rod includes a slot, said block being received in said slot.

11. The fitting according to claim 5, wherein said blocking device includes a slide having a block at its front extremity, said edge plate including an opening, said block cooperating with said opening in the latched position.

12. The fitting according to claim 10, wherein said front extremity includes a vertical branch, said block being mounted on said vertical branch.

13. The fitting according to claim 11, wherein said front extremity includes a vertical branch, said block being mounted on said vertical branch.

14. The fitting according to claim 2, wherein said electric blocking device includes a slide, and said second case includes an opening, and further including means for manual movement of said slide, said means for manual movement being accessible through said opening.

15. The fitting according to claim 14, wherein said means to controlling the movement of said electric blocking device includes a blocking stop interrupter and an opening stop interrupter, said slide including a first wing and a second wing, one of said first wing and said second wing contacting said blocking stop interrupter to stop said slide in the latched position, the other of said first wing and said second wing contacting said opening stop interrupter to stop said slide in a retracted position.

16. The fitting according to claim 15, wherein said means for manual movement of said slide includes at least one of said first wing and second wing.

17. The fitting according to claim 2, wherein said electric blocking device includes a slide, further comprising an electric motor having a drive shaft, said drive shaft being substantially perpendicular to the direction of movement of said slide, said slide including a rack, and a toothed-wheel mounted on said drive shaft to engage said rack to move said slide.

18. The fitting according to claim 2, wherein said electric blocking device includes a slide, further comprising an electric motor having a drive shaft, said drive shaft being substantially perpendicular to the direction of movement of said slide, said slide including a cut portion, and an eccentric connected to said drive shaft to engage said cut portion to move said slide.

19. The fitting according to claim 18, further comprising manual control means for manual movement of said slide, said manual control means including a wing extending parallel to said slide, said wing including a rack, a toothed-crown connected to said eccentric to engage said rack, a control lever attached to said wing so that manual movement of said control lever moves said slide.

20. The fitting according to claim 5, further comprising a guide element position in said first case, said guide element including means to guide said operating rod and said connecting element, said guide element also including means to engages said edge plate.

* * * * *